US005164744A

United States Patent [19]

Yoshida et al.

[11] Patent Number: 5,164,744

[45] Date of Patent: Nov. 17, 1992

[54] THERMAL TRANSFER PRINTING APPARATUS

[75] Inventors: Takashi Yoshida, Ibaraki; Tsutomu Oomine, Mito, both of Japan

[73] Assignees: Hitachi Ltd.; Hitachi Koki Co., Ltd., both of Japan

[21] Appl. No.: 720,616

[22] Filed: Jun. 25, 1991

[30] Foreign Application Priority Data

Jun. 29, 1990 [JP] Japan ..... 2-171799

[51] Int. Cl.[5] ..... B41J 35/04

[52] U.S. Cl. ..... 346/76 PH; 400/248

[58] Field of Search ..... 346/76 PH; 400/248, 400/241.2, 207

[56] References Cited

U.S. PATENT DOCUMENTS

| | | | |
|---|---|---|---|
| 4,329,075 | 5/1982 | Applegate et al. | 400/248 |
| 4,507,667 | 3/1985 | Tsuboi | 346/76 PH |
| 4,532,524 | 7/1985 | Yana et al. | 346/76 PH |
| 4,641,148 | 2/1987 | Dyer et al. | 400/248 |
| 4,739,341 | 4/1988 | Matsuno et al. | 346/76 PH |
| 4,834,563 | 5/1989 | Ozawa et al. | 400/207 |
| 4,892,425 | 1/1990 | Shimizu et al. | 400/120 |
| 4,910,602 | 3/1990 | Sakugari | 346/76 PH |

FOREIGN PATENT DOCUMENTS

| | | |
|---|---|---|
| 60-23078 | 2/1985 | Japan . |
| 60-27579 | 2/1985 | Japan . |
| 0068290 | 4/1986 | Japan . |
| 0268468 | 11/1986 | Japan . |
| 0108090 | 5/1987 | Japan . |
| 2-94137 | 7/1990 | Japan . |

*Primary Examiner*—Benjamin R. Fuller
*Assistant Examiner*—N. Le
*Attorney, Agent, or Firm*—Evenson, Wands, Edwards, Lenahan & McKeown

[57] ABSTRACT

A thermal transfer printing apparatus includes an ink cassette having an ink supply roll and an ink take-up roll, and a thermal head for pressing ink paper, fed from the ink supply roll, against printing paper so as to transfer ink in the ink paper to the printing paper through heating. The ink paper subjected to the transfer is peeled from the printing paper, and then is taken up by the ink take-up roll. This apparatus further includes a generally V-shaped peel pawl provided on the thermal head, and an ink guide provided on the ink cassette. The ink paper subjected to the transfer is peeled from the printing paper by the peel pawl and the ink guide. The printing paper thus peeled is taken up by the ink take-up roll via the ink guide. With this construction, the angle of the peel pawl relative to the printing paper can be made close to 90°, thereby reducing a peel force and effecting the transfer satisfactorily.

6 Claims, 15 Drawing Sheets

THERMAL TRANSFER PRINTING APPARATUS

BACKGROUND OF THE INVENTION

1. Field of the Invention

This invention relates to a thermal transfer printing apparatus, and more particularly to a thermal transfer printing apparatus of the type in which a peel angle between ink paper and printing paper can be large.

2. Description of the Prior Art

In conventional printing apparatuses as disclosed in Japanese Patent Unexamined Publication Nos. 60-23078 and 60-27579, a peel guide and an ink supply guide are provided on a body of the apparatus. In such prior art, there is no clear disclosure of a peel mechanism for use with ink paper which employs a pigment or a dye and is capable of density gradation.

There has also been proposed a printing apparatus, as disclosed in Japanese Utility Model Unexamined Publication No. 2-94137, in which there is provided a ribbon peel mechanism for taking up or winding up a peeled ink ribbon through a guide roller.

In the above conventional printing apparatuses, however, consideration is not given to the force of peel of the ink paper from the printing paper, the amount of transfer of the ink, and wrinkles developing in the ink paper. Therefore, there have been encountered problems such as an excessive peel force, an insufficient transfer, uneven density, and wrinkles in the ink paper.

In addition, when the ink paper is to be set in position, much time and labor have been required for changing an ink paper supply roll and an ink paper take-up roll and for positioning the ink paper with respect to the thermal head. This is another problem with the prior art.

SUMMARY OF THE INVENTION

With the above problems of the prior art in view, it is an object of this invention to provide a thermal transfer printing apparatus which has a peel mechanism which can reduce a peel force and effect a satisfactory transfer, and uses ink paper capable of reducing the peel force, and has a wrinkle prevention mechanism, and facilitates the setting of the ink paper on the apparatus.

To achieve the above object, according to a first aspect of the present invention, there is provided a thermal transfer printing apparatus comprising an ink cassette having an ink supply roll and an ink take-up roll; and a thermal head for pressing ink paper, fed from the ink supply roll, against printing paper so as to transfer ink in the ink paper to the printing paper through heating, the ink paper subjected to the transfer being peeled from the printing paper, and then being taken up by the ink take-up roll; the apparatus further comprising:

a generally V-shaped peel pawl provided on the thermal head; an ink guide provided on the ink cassette; the ink paper subjected to the transfer being peeled from the printing paper by the peel pawl and the ink guide; and the printing paper thus peeled being taken up by the ink take-up roll via the ink guide.

According to a second aspect of the invention, there is provided a thermal transfer printing apparatus comprising an ink cassette having an ink supply roll and an ink take-up roll; and a thermal head for pressing ink paper, fed from the ink supply roll, against printing paper so as to transfer ink in the ink paper to the printing paper through heating, the ink paper subjected to the transfer being peeled from the printing paper, and then being taken up by the ink take-up roll; the apparatus further comprising:

a peel pawl mounted on that portion of a base plate of the thermal head disposed downstream of the heating position of the thermal head in the direction of travel of the ink paper, that portion of the peel pawl for being contacted with the ink paper having a V-shape, and extending in the direction of the width of the ink paper; and an ink guide disposed upstream of the ink take-up roll of the ink cassette and downstream of the peel pawl so as to change the direction of travel of the ink paper.

In the apparatus of the above second aspect, the ink guide can be disposed between the peel pawl and a holder of the ink take-up roll so as to limit the angle between the ink paper, peeled from the printing paper, and the printing paper, and there can be provided another ink guide disposed between a holder of the ink supply roll and the thermal head so as to limit the angle of the ink paper to be supplied to the thermal head.

In the apparatus of the above second aspect, the peel pawl and the base plate of the thermal head can be made of the same material, and be formed integrally with each other.

According to a third aspect of the invention, there is provided a thermal transfer printing apparatus comprising an ink cassette having an ink supply roll and an ink take-up roll; and a thermal head for pressing ink paper, fed from the ink supply roll, against printing paper so as to transfer ink in the ink paper to the printing paper through heating, the ink paper subjected to the transfer being peeled from the printing paper, and then being taken up by the ink take-up roll; the apparatus further comprising:

a rotation mechanism mounted on that portion of the thermal head disposed downstream of the heating position of the thermal head in the direction of travel of the ink paper, that portion of the rotation mechanism for being contacted with the ink paper extending in the direction of the width of the ink paper; and an ink guide disposed upstream of the ink take-up roll of the ink cassette so as to change the direction of travel of the ink paper.

In the above apparatuses, the ink guide may serve as a rotatable peel guide. In this case, the ink cassette includes means for rotating the peel guide, and a rotatable roller is mounted on a body of the apparatus so as to cooperate with the peel guide to hold the peeled ink paper between the roller and the peel guide, and the axis of rotation of the roller being disposed parallel to the axis of rotation of the peel guide.

According to a fourth aspect of the invention, there is provided a thermal transfer printing apparatus comprising a body including printing paper supply means, ink film heating means and ink film moving means; and an ink cassette containing an ink film and removably attached to the body;

the apparatus further comprising positioning guide portions of square and rounded shapes provided on side surfaces of the ink cassette; and guide groove portions provided at the body, the guide portions being engaged in the guide grooves portions, respectively.

According to a fifth aspect of the invention, there is provided a thermal transfer printing apparatus comprising an ink cassette which includes a supply roller holder, a take-up roller holder, and at least one ink guide provided between the supply roll holder and the take-up roller holder and extending in the direction of the width of ink paper so as to change the direction of travel of the ink paper;

that surface of the ink guide for being contacted with a central portion of the ink paper in the direction of the width of the ink paper being convex toward the ink paper.

According to a sixth aspect of the invention, there is provided a thermal transfer recording apparatus comprising an ink cassette which includes a supply roller holder, a take-up roller holder, and at least one ink guide provided between the supply roll holder and the take-up roller holder and extending in the direction of the width of ink paper so as to change the direction of travel of the ink paper;

the ink cassette further including a passage prevention member provided between the ink guide, disposed upstream of the take-up roll holder, and the take-up roller holder so as to prevent the ink paper and/or an ink take-up roll from passing through a plane extending between the ink guide and the take-up roll holder.

In the apparatus of the sixth aspect, one end of the passage prevention member remote from the take-up roller holder may serve as the ink guide, and in this case the ink guide serves as a peel guide.

According to a seventh aspect of the invention, there is provided a thermal transfer printing apparatus comprising an ink cassette which includes a supply roller holder, a take-up roller holder, and at least one ink guide provided between the supply roll holder and the take-up roller holder and extending in the direction of the width of ink paper so as to change the direction of travel of the ink paper; the ink cassette further including the ink guide being movable in the direction of travel of the ink paper, means for moving the ink guide toward and away from a thermal head mounted on a body of the thermal transfer printing apparatus, and the moving means being operatively connected to means for changing the position of the thermal head.

According to an eighth aspect of the invention, there is provided a thermal transfer printing apparatus comprising an ink cassette having an ink supply roll and an ink take-up roll, and a thermal head for pressing ink paper, fed from the ink supply roll, against printing paper so as to transfer ink in the ink paper to the printing paper through heating, the ink paper comprising a film-like flexible substrate and an ink layer formed on one side of the substrate, the ink paper having a material of a low friction coefficient coated on the other side of the substrate, and the ink layer having a porous structure in which contains a pigment and/or a dye and a binder.

In the apparatus of the eighth aspect, the ink paper may have a release layer interposed between the ink layer and the substrate.

In the apparatus of the eighth aspect, the ink paper may have particles of a material mixed into the ink layer or a porous layer formed by containing particles of a material and a binder in the surface of the ink layer, the melting point of the particles of the material being higher than the temperature to which the ink layer is caused to rise by heating during a thermal transfer operation.

Since the peel angle between the ink paper and the printing paper is kept constant by the peel pawl, provided on the thermal head, and the peel guide provided on the ink cassette, a picture image free from uneven density can be obtained.

By providing the peel guide on the ink cassette, the peel guide can be disposed close to the peel pawl, and therefore the peel angle can be made larger. By doing so, the peel force can be reduced, and the transfer density can be made higher, thereby providing a picture image free from uneven density.

The ink guide (peel guide) is movable so that it can be disposed upstream of the peel position during the printing (thermal transfer) operation, and therefore a large peel angle can be obtained, and the peel force is reduced, and the transfer density as well as the uneven density is improved.

By providing the ink guide (which serves as the ink supply guide) on the ink cassette, tension is applied to that portion of the ink paper extending between the ink supply guide and the thermal head, thereby preventing wrinkles from developing in the ink paper.

When the surfaces of the peel guide and the ink supply guide for contact with the central portion of the ink paper in the direction of the width of the ink paper are formed into a convex shape, the tension directed from the widthwise central portion toward the lateral sides of the ink paper is produced, so that the ink paper is prevented from being subjected to wrinkles. Similar effects can be obtained when the peel guide is rotated to apply tension to the ink paper under a constant torque.

When the coating of a material, which can be easily released or peeled, is provided between the substrate and the ink layer of the ink paper of the density gradation type which contains a pigment and a dry, the peel force is reduced.

When particles of a non-melting filler are mixed into the ink layer, the peel force is reduced.

The ink cassette has the ink paper supply roll, the peel guide, and the take-up roll for taking up the peeled ink paper, and also the positioning guide portions of square and rounded shapes are provided on the side surfaces of the ink cassette, and the guide groove portions engaged respectively with these guide portions are provided on the body of the thermal transfer printing apparatus. Therefore, the ink paper can be quite easily set on the body of the thermal transfer printing apparatus through the ink cassette.

DETAILED DESCRIPTION OF THE PREFERRED EMBODIMENTS

Figure 1:
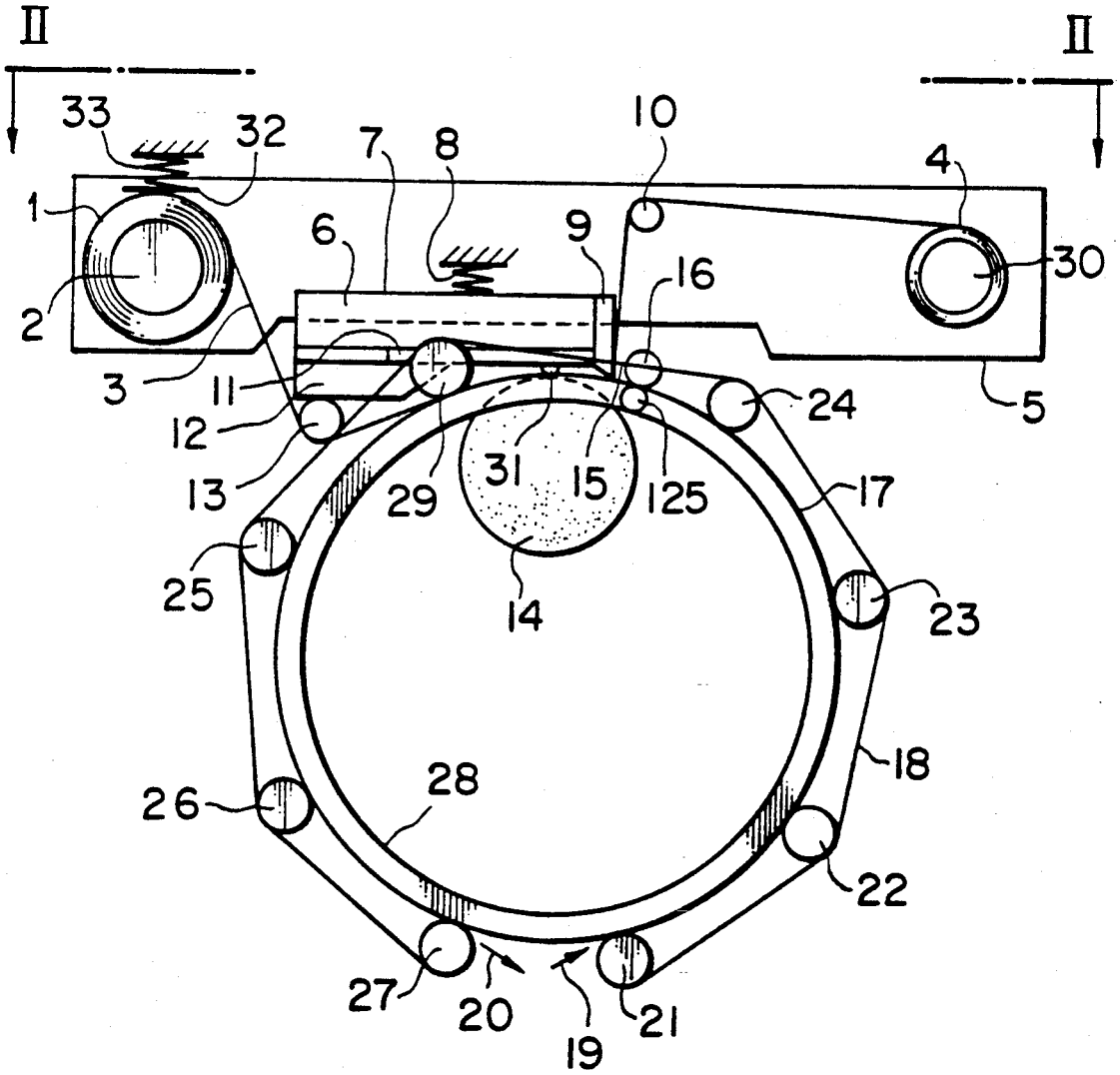
FIG. 1 is a cross-sectional view of an important portion of a first embodiment of thermal transfer printing apparatus of the present invention.
Figure 2:
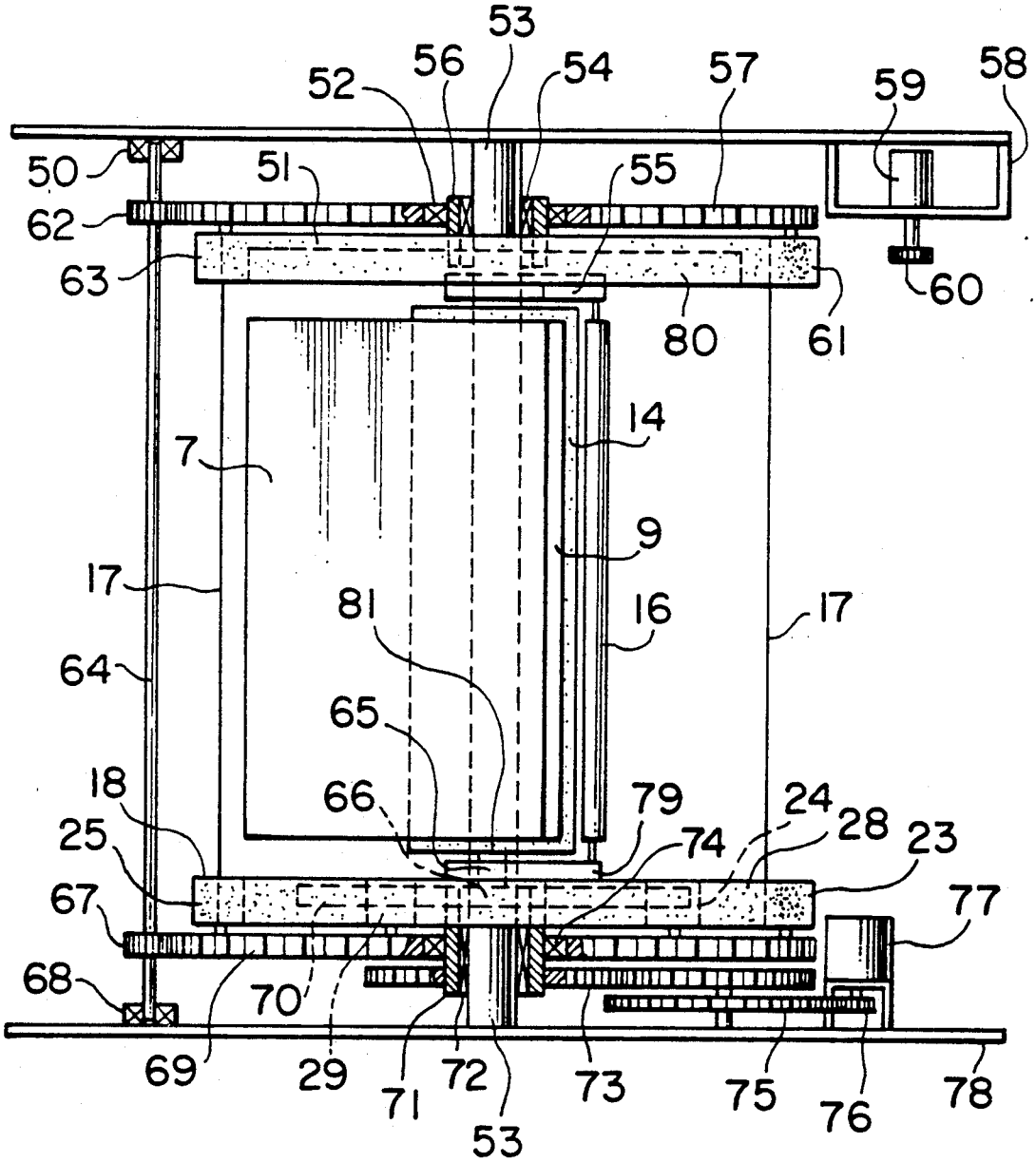
FIG. 2 is a plan view as seen from the line II—II of FIG. 1.

A first embodiment of a thermal transfer printing apparatus of the present invention will now be described with reference to FIGS. 1 and 2. FIGS. 1 and 2 show a printing mechanism of the thermal transfer printing apparatus of the invention using an ink cassette according to the present invention. FIG. 2 is a view as seen from the upper side of FIG. 1.

First, constitution of important portions of the thermal transfer printing apparatus body and the ink cassette which are related to the present invention will be described with reference to FIGS. 1 and 2. The mechanism of the thermal transfer printing apparatus concerned with the present invention is symmetrical right and left except for a printing portion rotation mechanism (which has a stepping motor 77 and gears 76, 75 and 73) and an ink film take-up rotation mechanism which has a motor 59 and a gear 60. This mechanism comprises a fixed shaft 53 fixedly mounted on frames 58 and 78, support members 55 and 79 mounted on the fixed shaft 53, bearings 65 mounted respectively on the support members 55 and 79 (the bearing mounted on the support member 55 is not shown), an upper roller 16 rotatably supported by the support members 55 and 79, bearings 72 and 54 mounted on the fixed shaft 53, rotation shafts 71 and 56 rotatably mounted respectively on the bearings 72 and 54, the gear 73 mounted on the rotation shaft 71, one-way clutches 74 and 52 mounted respectively on the rotation shafts 71 and 56, gears 69 and 57 mounted respectively on the one-way clutches 74 and 52, a roller A 21, a roller B 22, a roller C 23, a roller D 24, a roller E 29, a roller F 25, a roller G 26, a roller H 27, a roller J 61 and a roller K 63 which are driven by the gears 69 and 57 for rotation, a belt 18 passing from the roller A 21 to the roller H 27 and held in contact with a flange 28 (a belt 80 is in contact with the rollers J and K), gears 70 mounted respectively on the rotation shafts 71 and 56 (the gear mounted on the rotation shaft 56 is not shown), flanges 28 and 51 mounted respectively on the rotation shafts 71 and 56, and gears 66 (one of which is not shown on the side of the rotation shaft 56) supplied with power from the gears 70. The gear 66 is mounted on a rotation shaft 81 of a rubber roller 14. The rotation shaft 81 is rotatably supported by the bearings 65. One-way clutches 68 and 50 are mounted respectively on the frames 78 and 58, and a shaft 64 is connected to these one-way clutches 68 and 50. Gears 67 and 62 mounted on the shaft 64 are in mesh with the gears 69 and 57, respectively. A DC motor 59 is mounted on the frame 58, and the gear 60 is connected to the DC motor 59. The DC motor 59 and the gear 60 rotate an ink take-up roll 4. The DC motor 59 is controlled to provide a constant torque, or is designed to transmit a constant torque through a friction clutch connected to the gear 60. A thermal head 7 comprises a base plate 6, an alumina plate 11 and a cover 12. A peel pawl 9 is mounted on the base plate 6 of the thermal head 7. An ink guide 13 with a cover is mounted on the cover 12. The thermal head 7 is urged by a spring 8 during the printing. A heater element 31 mounted on the alumina plate 11 is heated during the printing, so that a pigment and wax, or a sublimation dye ink, coated on ink paper 3 (hereinafter referred to as "ink film") is fused, or sublimated, thereby printing an image on a printing paper sheet 17. The ink cassette 5 comprises an ink supply roll 1, the ink take-up roll 4 and an peel guide 10 serving as an ink guide. The ink supply roll 1 has a winding core 2 on which the ink film 3 is wound, and supplies ink toward the thermal head 7. The ink take-up roll 4 takes up the ink film 3 by winding on a winding core 30 the ink film 3 which has been subjected to a printing operation at the thermal head 7. The peel guide 10 is provided to keep a peel angle 15 between the peel pawl 9 and the printing paper 17 constant.

The operation will now be described.

During the paper supply, the thermal head 7 is spaced apart from the rubber roller 14, and in this condition the flanges 28 and 51 and the rubber roller 14 are rotated in a counterclockwise direction, and the printing paper 17 is fed from a paper supply port 19 and is wound on the flanges 28 and 51. The printing paper 17 is fixed between the belt 18 and the flange 28 and between the belt 80 and the flange 51. At this time, the gears 69 and 57 are respectively prevented by the one-way clutches 74 and 52 from receiving the power from the rotation shafts 71 and 56, and therefore are not rotated. Also, the shaft 64 on which the gears 67 and 62 are mounted is prevented by the one-way clutches 68 and 50 from rotation.

During the printing, the thermal head 7 is urged by the spring 8 toward the rubber roller 14 so as to hold the ink film 3 and the printing paper 17 between the thermal head 7 and the rubber roller 14. The rotation shafts 71 and 56 are rotated in a clockwise direction, and as a result the gears 69 and 57 and the gears 70 (the gear on the rotation shaft 56 is not shown) are rotated, and also the rubber roller 14 is rotated. The rotation of the gear 57 is transmitted by the gears 67 and 62, and the rotation of the flange 51 is transmitted by the gear 66 and the rubber roller 14 (the gear of the rubber roller shaft on the side of the flange 51 is not shown). The relation between the peripheral speed F of the flanges 28 and 51 and the peripheral speed R of the rubber roller 14 at this time is represented by $F \leqq R$. Therefore, the printing paper 17 is subjected to tension. The amount of heat generated by the heater element 31 of the thermal head 7 is controlled in accordance with input image data, so that the ink of the ink film 3 is transferred to and printed on the printing paper 17 by melt or sublimation. After the printing, the ink film 3 is peeled or separated from the printing paper 17 by the peel pawl 9 and the peel guide 10. The upper roller 16 serves to hold the printing paper 17 so that the printing paper 17 will not be lifted by the ink film 3. The upper roller 16 also cooperates with a lower roller 125 to hold the printing paper 17 therebetween, thereby providing a better effect.

The peel angle 15 of over 90° can be obtained by the peel pawl 9 and the peel guide 10, and the peel angle 15 always kept to a constant value can be obtained by the control of the rotation torque of the ink take-up roller 4 and by the effect of the upper roller 16. By mounting the peel guide 10 on the ink cassette 5, the peel guide 10 can be disposed closer to the thermal head 7, so that the peel angle 15 can be over 90°. A force to restrain the rotation of the ink supply roll 1 is applied from a friction plate 32 and a spring 33 to the ink supply roll 1 so that tension can be applied to that portion of the ink film 3 extending between the ink supply roll 1 and the thermal head 7. The ink guide 13 with the cover serves to prevent wrinkles from developing in the ink film 3.

During the paper discharge, the rotation shafts 71 and 56 are rotated in a counterclockwise direction, and only the flanges 28 and 51 are rotated, thereby discharging the printing paper from a paper discharge port 20.

Figure 3:
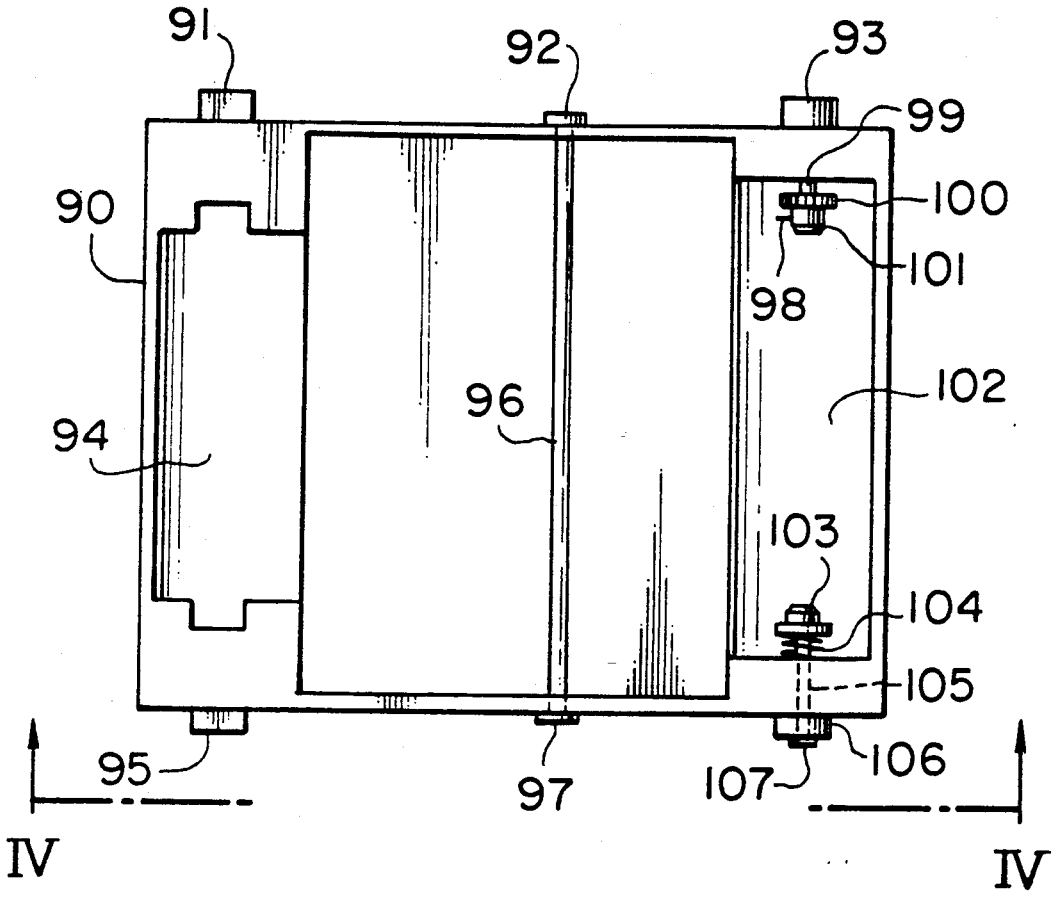
FIG. 3 is a plan view of a first example of ink cassette of the invention.
Figure 4:
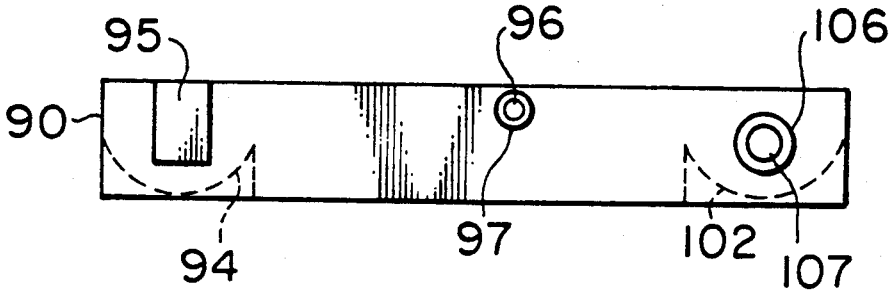
FIG. 4 is a side-elevational view as seen from the line IV—IV of FIG. 3.

Next, a first example of ink cassette of the present invention will be described. FIG. 3 shows the construction of this embodiment, and FIG. 4 is a side-elevational view as seen from the line IV—IV of FIG. 3. The illustrated ink cassette comprises a supply roll holder 94 for receiving the ink supply roll, a take-up roll holder 102 for receiving the ink take-up roll, square guides 91 and 95 and rounded guides 93 and 106 for insertion into their respective mating portions of the frames of the printing apparatus so as to position the ink cassette in place, and a peel guide 96. These parts are provided on a frame 90 of the ink cassette. The peel guide 96 is fixedly or rotatably attached at its opposite ends to the frame 90 by retainer rings 92 and 97. The take-up roll holder 102 comprises a fitting portion 101 which is adapted to fit in one end of the winding core 30 of the ink winding roll 4, and has a claw 98 for preventing the rotation of the winding core 30, a shaft 99 rotatably supporting the fitting portion 101, a gear 100 fixedly mounted on the shaft 99, a fitting portion 103 for fitting in the other end of the winding core 30, a shaft 105 supporting the fitting portion 103 in such a manner that the fitting portion 103 is rotatable about the axis of the shaft 99 and is movable back and forth along the axis of the shaft 99, and a retainer ring 107 retaining the shaft 105 to the frame 90 through the rounded guide 106, and a spring 104 fitted on the shaft 105 between the fitting portion 103 and the frame 90 to urge the fitting portion 103 toward the fitting portion 101.

Figure 5:
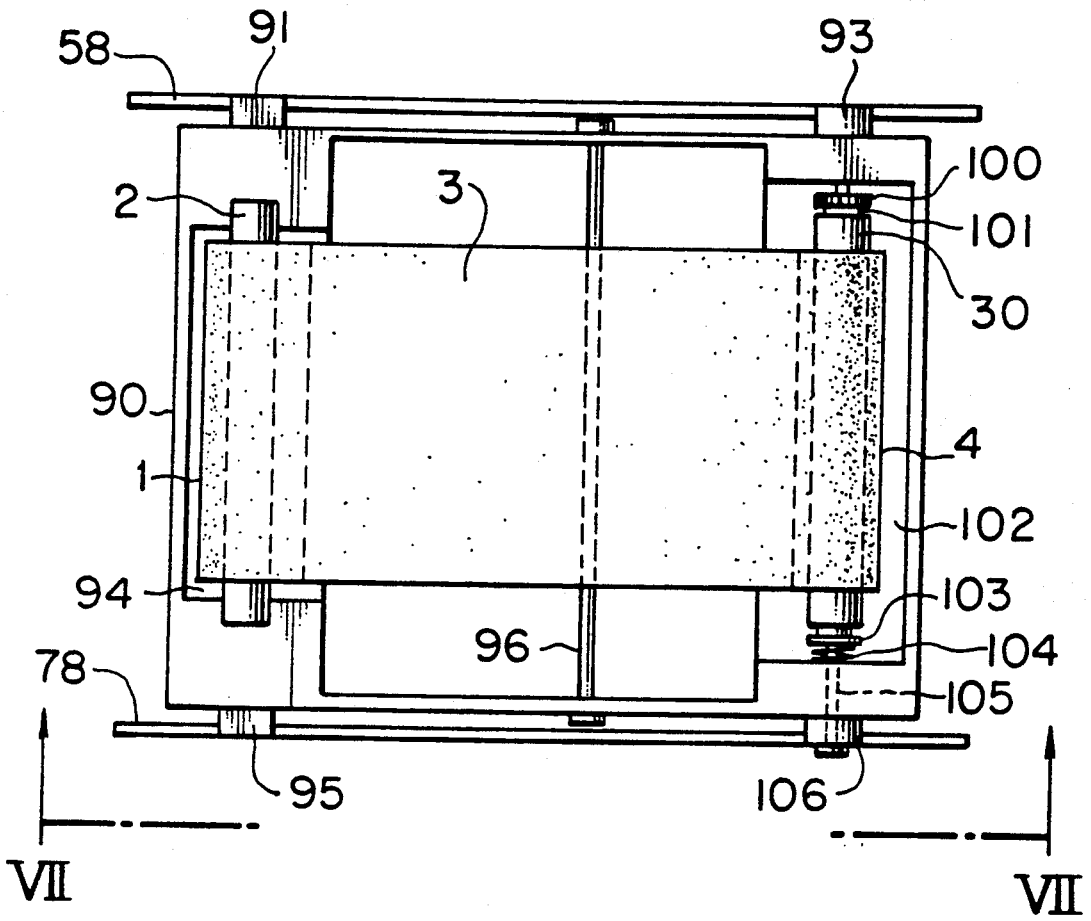
FIG. 5 is a plan view showing the ink cassette of FIG. 3 as attached to the thermal transfer printing apparatus.

FIG. 5 shows the condition in which the ink supply roll 1 and the ink take-up roll 4 are attached to the ink cassette of FIG. 3. For attaching the ink supply roll 1 and the ink take-up roll 4 to the ink cassette, the winding core 2 of the ink supply roll 1 is first inserted into the supply roller holder 94, and then the ink film 3 is passed over the peel guide 96, and then the opposite ends of the winding core 30 of the ink take-up roll 4 are fitted respectively on the fitting portions 101 and 103, thereby finishing this attachment operation.

Figure 6:
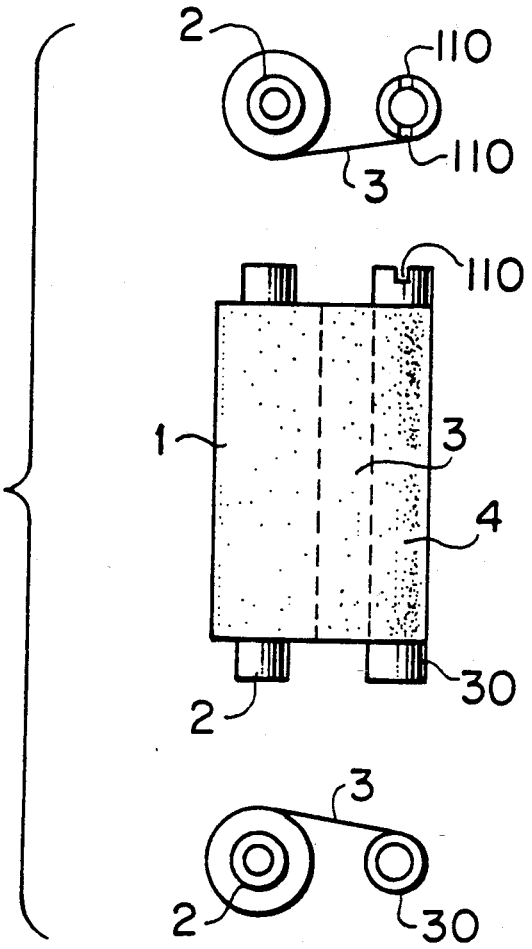
FIG. 6 is a plan view and side-elevational views showing the structures of an ink supply roll and an ink take-up roll.

FIG. 6 shows the structures of the ink supply roll 1 and the ink take-up roll 4. The ink film 3 is wound around the winding core 2 with its leading end portion wound on the winding core 30, and in this condition the ink film 3 is supplied to the user.

Notches 110 are formed in one end of the winding core 30, and the claw 98 is engaged in the notch 110, thereby preventing an erroneous attachment by the user.

Figure 7:
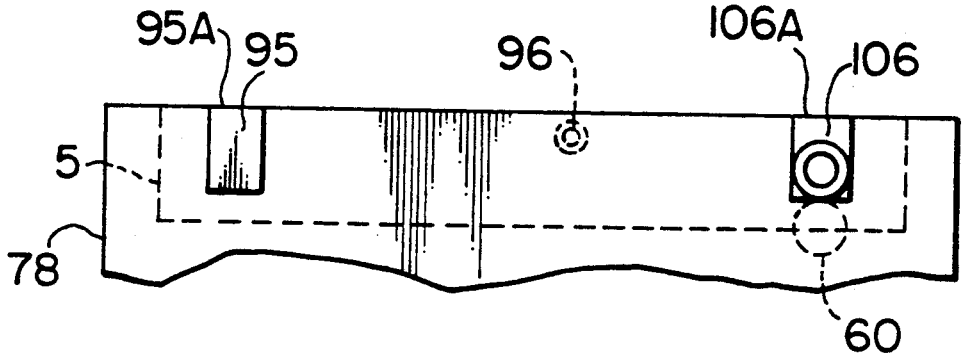
FIG. 7 is a side-elevational view as seen from the line VII—VII of FIG. 5.

FIGS. 5 and 7 show the relation between the ink cassette 5 and the frames 78 and 58 when this ink cassette 5 is attached to the printing mechanism. FIG. 7 is a side-elevational view of the construction shown in FIG. 5. The square guides 91 and 95 of the ink cassette 5 are fitted respectively in square guide reception portions (guide grooves) 91A and 95A (91A is not shown) formed respectively in the frames 78 and 58. Also, the rounded guides 106 and 93 of the ink cassette 5 are fitted respectively in rounded guide reception portions (guide grooves) 93A and 106A (93A is not shown) formed respectively in the frames 78 and 58. By doing so, the ink cassette 5 is positioned relative to the frames 78 and 58 in the upward-and-downward direction and the right-and-left direction. The gear 100 of the fitting portion 101 for the ink take-up roll is meshed with the gear 60 on the apparatus so as to transmit the power. As described above, in the peel mechanism of the thermal transfer printing apparatus, the peel pawl is mounted on the thermal head, and the peel guide is mounted on the ink cassette. With this construction, the peel angle between the printing paper and the ink film can be sufficiently large, and this provides advantages that the amount of transfer is stable, and that a high-quality picture image free from an uneven density can be obtained.

Figure 8:
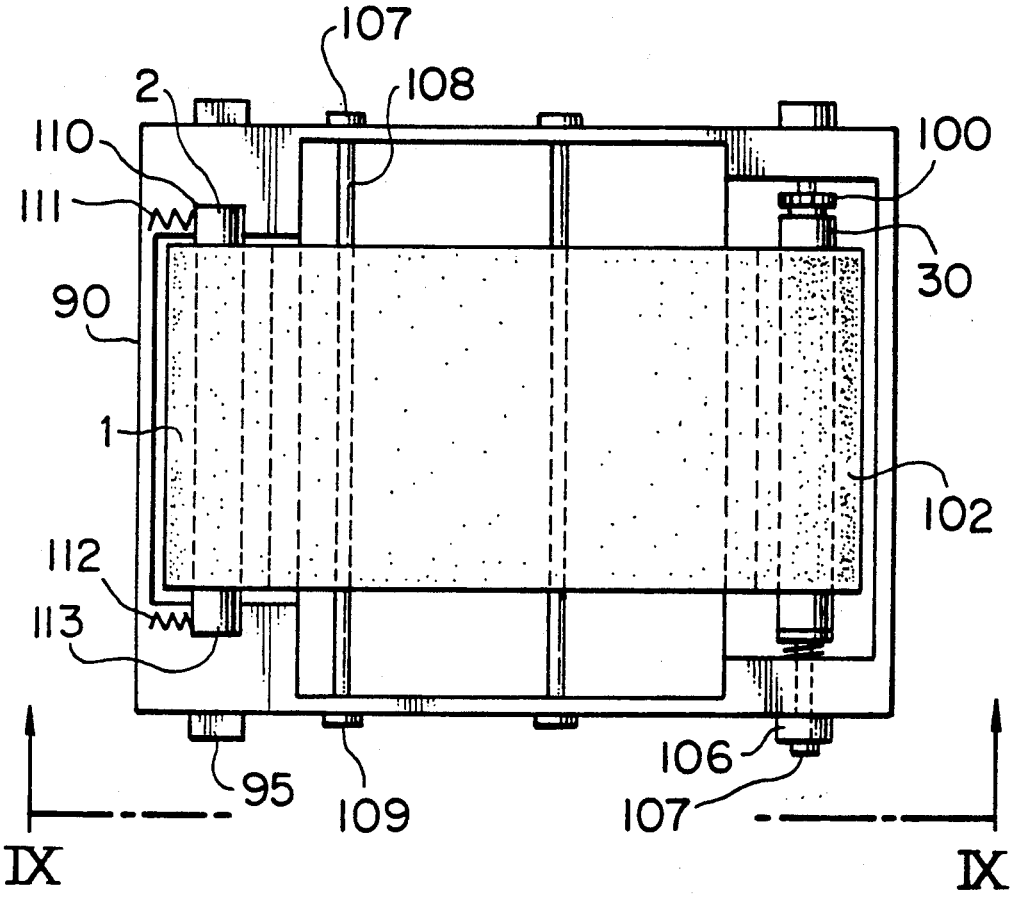
FIG. 8 is a plan view of a second example of ink cassette of the invention.
Figure 9:
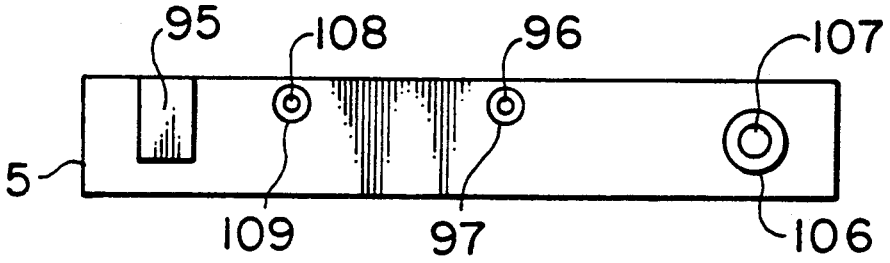
FIG. 9 is a side-elevational view as seen from the line IX—IX of FIG. 8.

Next, a second example of ink cassette of the present invention will be described with reference to FIGS. 8 and 9. In this example shown in FIG. 8, an ink guide 108 is provided on that side of the ink cassette from which the ink film is supplied to the thermal head. FIG. 9 is a view as seen from the side of the structure shown in FIG. 8. The ink guide 108 is fixedly or rotatably mounted on a frame 90 of the ink cassette by retainer rings 107 and 109. When the ink guide is thus provided on the ink cassette, tension can be applied to that portion of the ink film, extending between the ink guide and the thermal head, by a frictional force developing between the ink guide and the ink film. This advantageously prevents wrinkles from developing in the ink film.

Figure 10A:
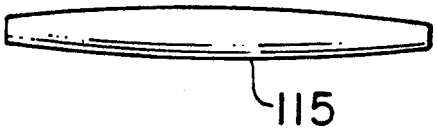
FIG. 10A is an elevational view showing the shape of an ink guide of the ink cassette of the invention.
Figure 10B:
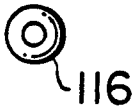
FIG. 10B is a side-elevational view of the ink guide of FIG. 10A.
Figure 11A:
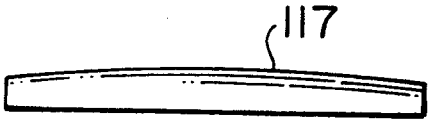
FIG. 11A is an elevational view showing the shape of a modified ink guide.
Figure 11B:
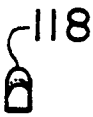
FIG. 11B is a side-elevational view of the ink guide of FIG. 11A.

Next, a third example of ink cassette of the present invention will be described with reference to FIGS. 10A to 11B. In these Figures, modified forms of peel guide or ink guide are shown. In FIGS. 10A and 10B, a rod 115 of a circular cross-section is increasing in diameter progressively from its opposite ends toward its central portion 116. In FIGS. 11A and 11B, a flat plate 117 is increasing in height progressively from its opposite ends toward its central portion 118. As shown in FIG. 11B, the shape of the surface 118 to be contacted with the ink film is arcuate. By thus changing the shape of the peel guide or the ink guide from its end to its central portion, the ink film is subjected to the tension which is directed from the central portion of the ink film toward the opposite ends of the ink film, so that the ink film is pulled outwardly, thereby preventing wrinkles from developing in the ink film.

Figure 12:
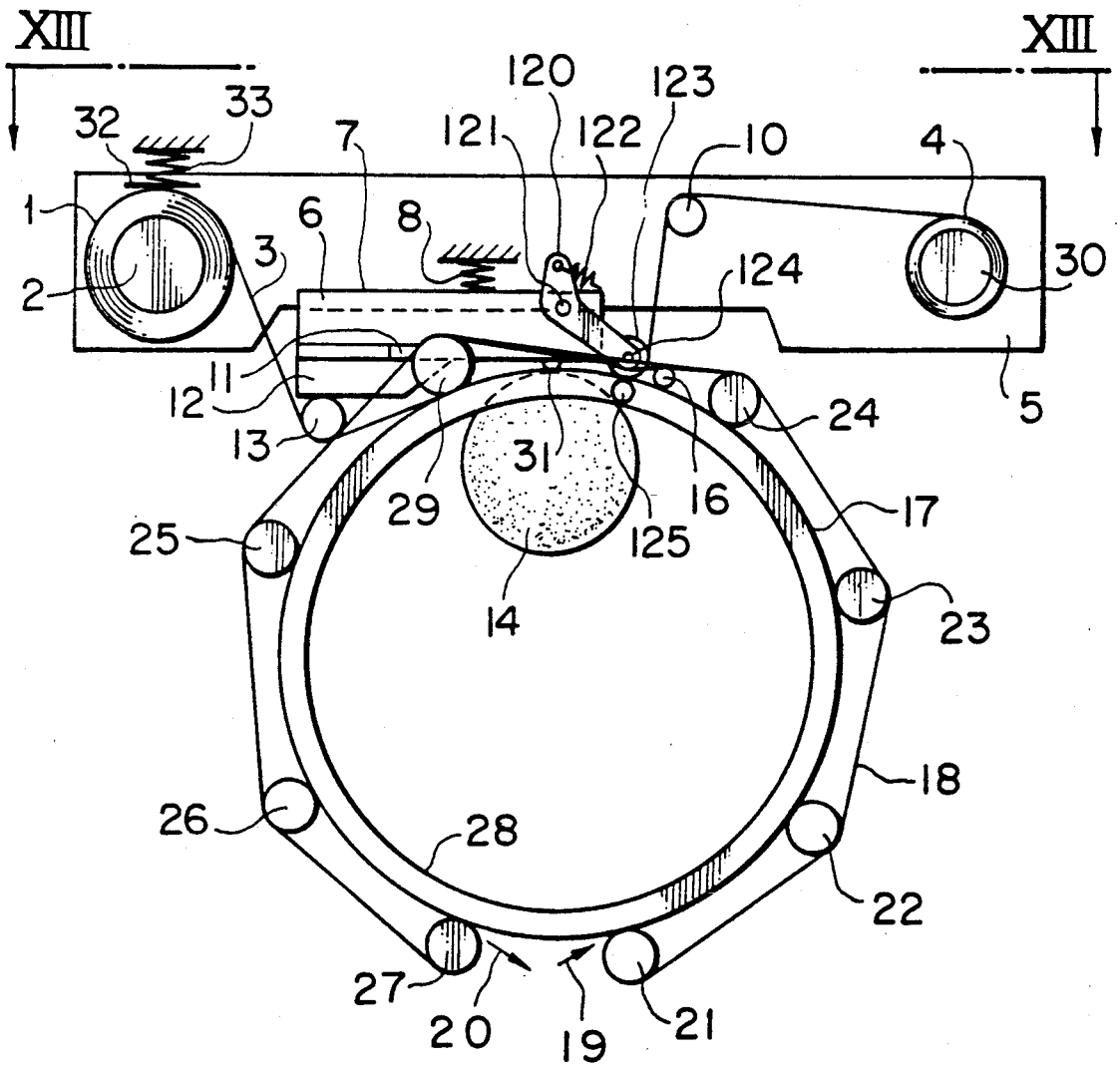
FIG. 12 is a cross-sectional view of an important portion of a second embodiment of thermal transfer printing apparatus of the invention.
Figure 13:
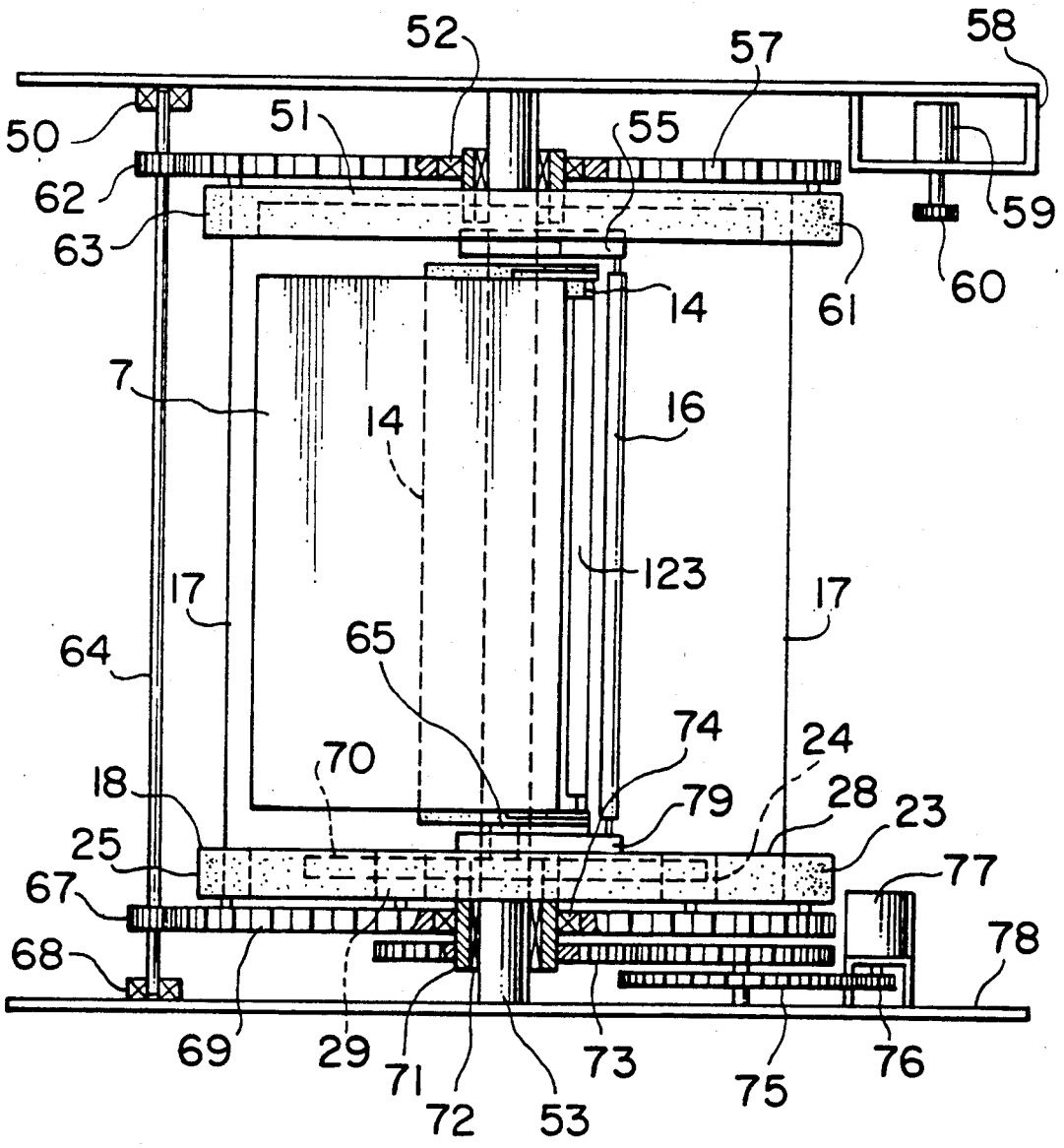
FIG. 13 is a plan view as seen from the line XIII—XIII of FIG. 12.

Next, a second embodiment of thermal transfer printing apparatus of the present invention will be described with reference to FIGS. 12 and 13. This embodiment of FIG. 12 differs from the thermal transfer printing apparatus of FIG. 1 in that the peel pawl 9 of FIG. 1 is replaced by a peel roller 123. The peel roller 123 is rotatably supported on a support member 120 through a shaft 124.

The support member 120 is supported on the base plate 6 of the thermal head 7 through a shaft 121, and that portion of the support member 120 on which the shaft 124 is mounted is urged downward by a spring 122 toward the flange 28. The lower roller 125 is rotatably supported by the support members 79 and 55. The ink film 3 and the printing paper 17 are held between the peel roller 123 and the lower roller 125. With this construction, the position of peel of the ink film 3 is made constant, so that a picture image free from uneven density can be obtained.

Figure 14:
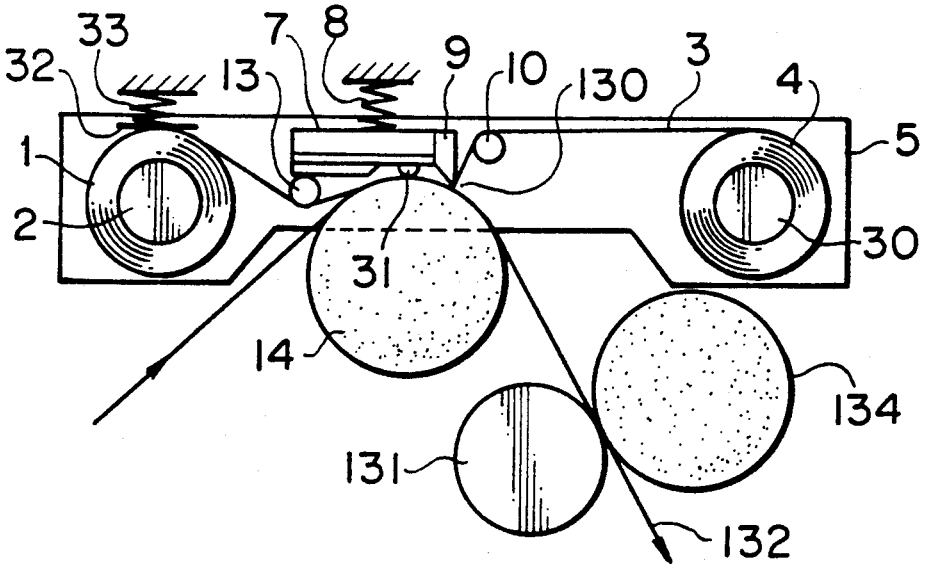
FIG. 14 is a cross-sectional view of a portion of a third embodiment of thermal transfer printing apparatus of the invention.

Next, a third embodiment of thermal transfer printing apparatus of the present invention will be described with reference to FIG. 14. In the thermal transfer printing apparatus shown in FIG. 14, printing paper 132 is fed by a rubber roller 134 and an abrasive roller 131, and the rubber roller 14 moved, following the movement of the printing paper. The abrasive roller 131 has particles of a hard material (e.g. alumina) bonded or fused to a surface of its roller body, these particles being capable of biting engagement with the printing paper. A suitable size of the particles is 60 to 100 μm. In the thermal transfer printing apparatus of this construction, also, the peel angle can be made over 90° by the provision of the peel pawl 9 and the peel guide 10, so that a picture image free from uneven density can be obtained.

Figure 15:
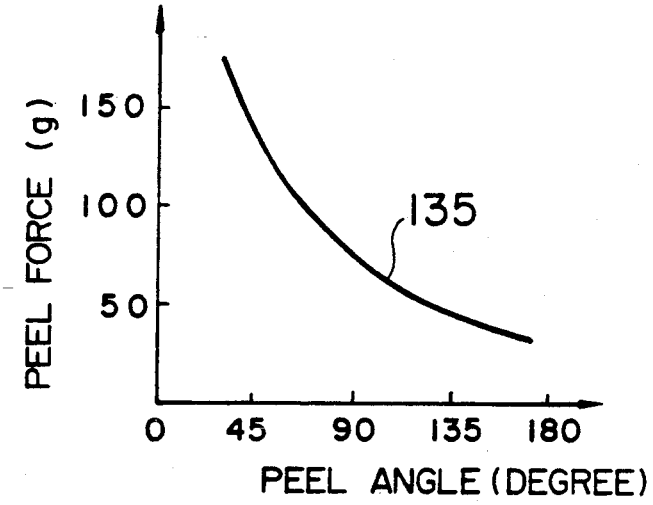
FIG. 15 is a graph showing the relation between a peel force and a peel angle of an ink film.

FIG. 15 is a graph showing the relation between the peel angle and the peel force of the ink film in the thermal transfer printing apparatus, in which the abscissa axis represents the peel force (g), and the ordinate axis represents the peel angle (degree). As indicated by a characteristics line 135, the greater the peel angle is, the smaller the peel force is.

Figure 16:
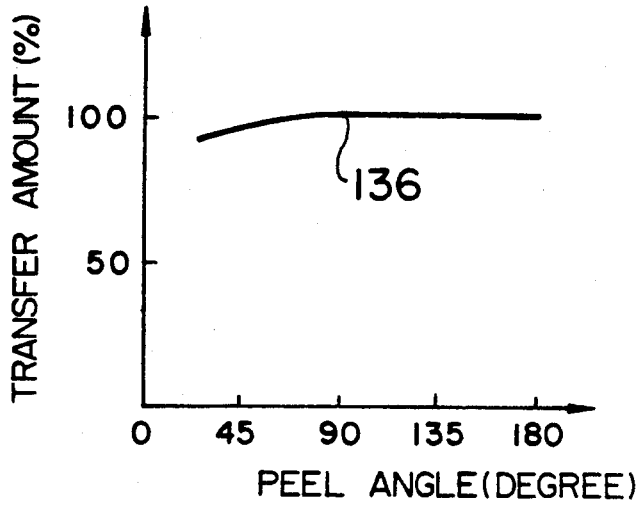
FIG. 16 is a graph showing the relation between a transfer amount and the peel angle of the ink film.

FIG. 16 is a graph showing the relation between the peel angle and the amount of thermal transfer of the ink in a thermal transfer printer, in which the abscissa axis represents the transfer amount (%), and the ordinate axis represents the peel angle (degree). As indicated by a characteristics line 136, the greater the peel angle is, the less the transfer unevenness is.

Figure 17:
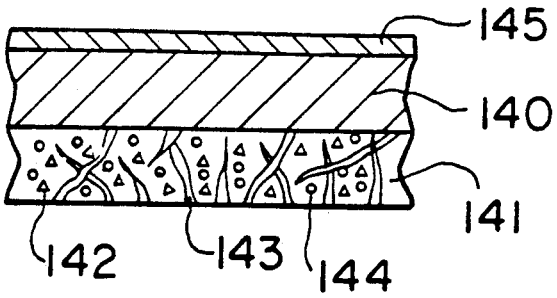
FIGS. 17 to 20 are cross-sectional views of examples of ink paper according to the invention, respectively.
Figure 22:
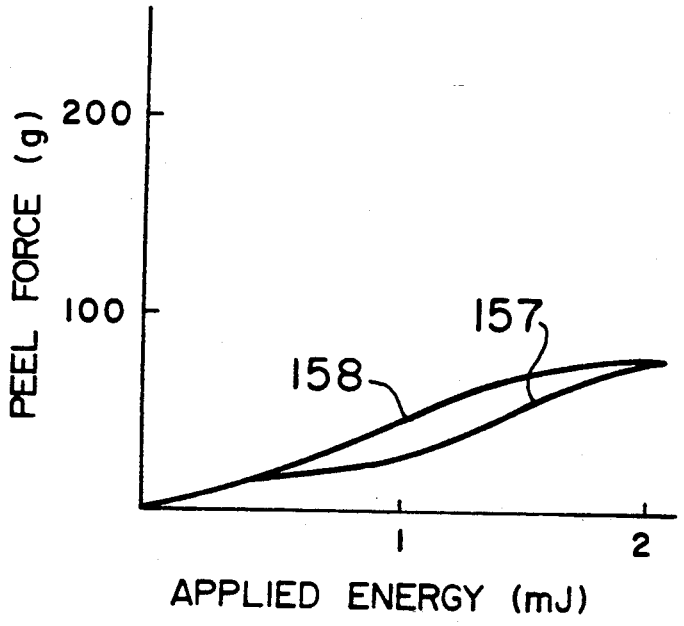

FIG. 17 shows the structure of an ink film of the present invention using a pigment or a dye of a density gradation-type. The ink film shown in FIG. 17 comprises a substrate 140 of polyester, a lubricating, low-friction coefficient back coating 145 formed on one side of the substrate 140, and an ink layer 141 coated on the other side of the substrate 140. In order for the ink film to have the continuous density gradation, a resin, in addition to a pigment or a dye 144 and a binder 142, is added to the ink layer 141 to form the ink layer into a porous structure 143 by the porous resin, and the ink 144 and the binder 142 are contained in this porous structure. The binder is made of wax, a softener or the like. With respect to the ink film of this type, the peel force is large, as indicated by a characteristics line 155 in FIG. 22. When such an ink film is used, a stable picture image free from uneven density can be obtained with the use of the peel mechanisms (shown in FIGS. 1, 12, 14, 25 and 27) capable of providing a large peel angle.

Figure 28:
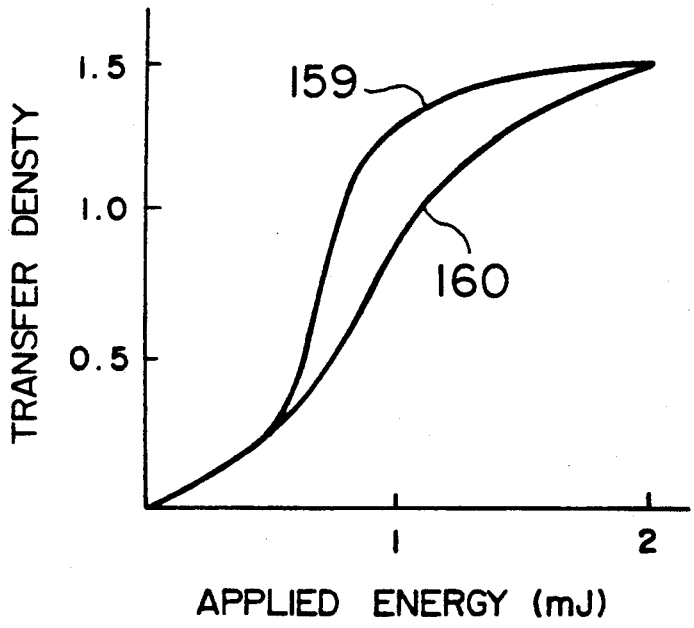
FIG. 28 is a graph showing the relation between the transfer density and the applied energy.

FIG. 28 shows a comparison between characteristics (indicated by a line 159) of a conventional ink film (which has a smaller peel angle and causes printing paper to be lifted at the time of the peel) and characteristics (indicated by a line 160) of the above-mentioned ink film of the present invention. In FIG. 28, the abscissa axis represents the transfer density, and the ordinate axis represents the applied energy. The applied energy-transfer density characteristics of the present invention represented by the line 160 are gentler, and particularly there can be obtained an effect that the saturation of the density is alleviated in the range from the moderate density to the high density.

Figure 18:
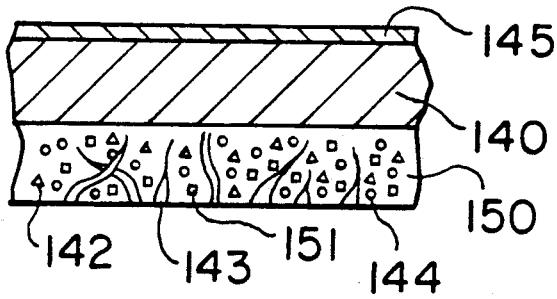
Figure 21:
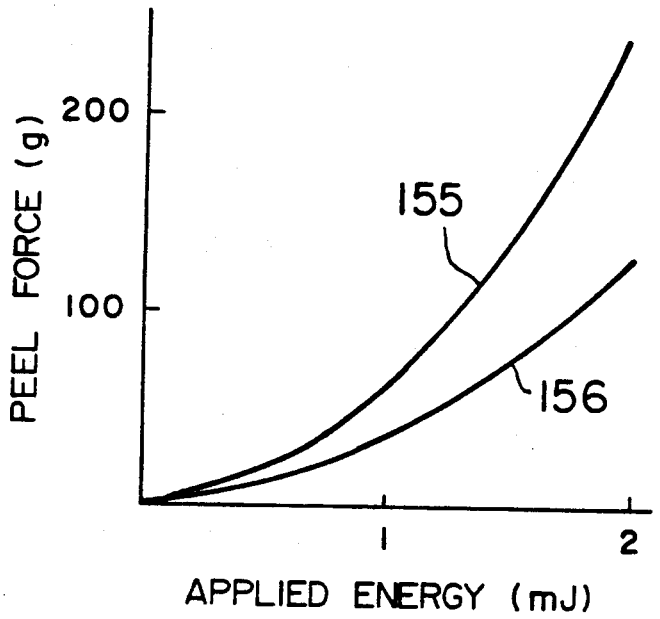
FIGS. 21 and 22 are graphs showing the relation between the peel force of the ink paper of the invention and an applied energy.

FIG. 18 shows another type of ink film in which a filler 151 is mixed into the ink layer of the ink film of FIG. 17. The ink film may have the porous layer formed by containing the filler 151 and the binder in the surface of the ink layer shown in FIG. 18. As the filler 151, alumina particles, quartz particles, carbon black particles or the like can be used. With the addition of the filler 151, the area of contact between the ink film and the printing paper is reduced, thereby providing an effect that this ink film with the filler (whose characteristics are indicated by a line 156 in FIG. 21) is smaller in peel force than the ink film without such a filler whose characteristics are indicated by the line 155.

Figure 19:
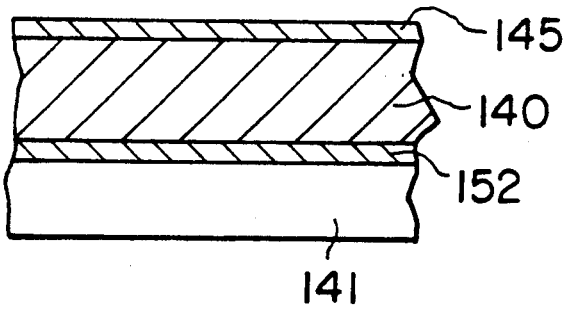
Figure 20:
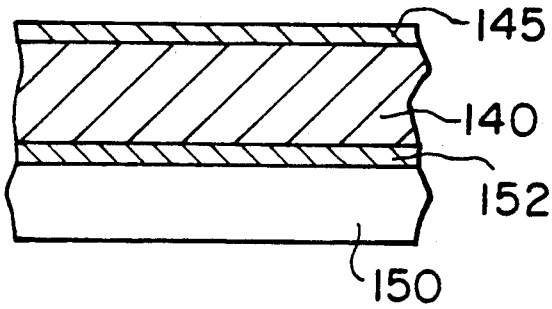

FIG. 19 shows an ink film which differs from the ink film of FIG. 17 in that a release or peel layer 152 is provided between the substrate 140 and the ink layer 141. FIG. 20 shows an ink film which differs from the ink film of FIG. 18 in that a release or peel layer 152 is provided between the substrate 140 and the ink layer 141. With the addition of the release layer 152, the peeling of the ink film occurs at the release layer 152 when the applied energy is increased. Therefore, as can be appreciated from characteristics (indicated by a line 157 in FIG. 22) of the ink film with both the filler and the release layer and characteristics (indicated by a line 158) of the ink film without the filler but with the release layer, the peel force is reduced.

Figure 23:
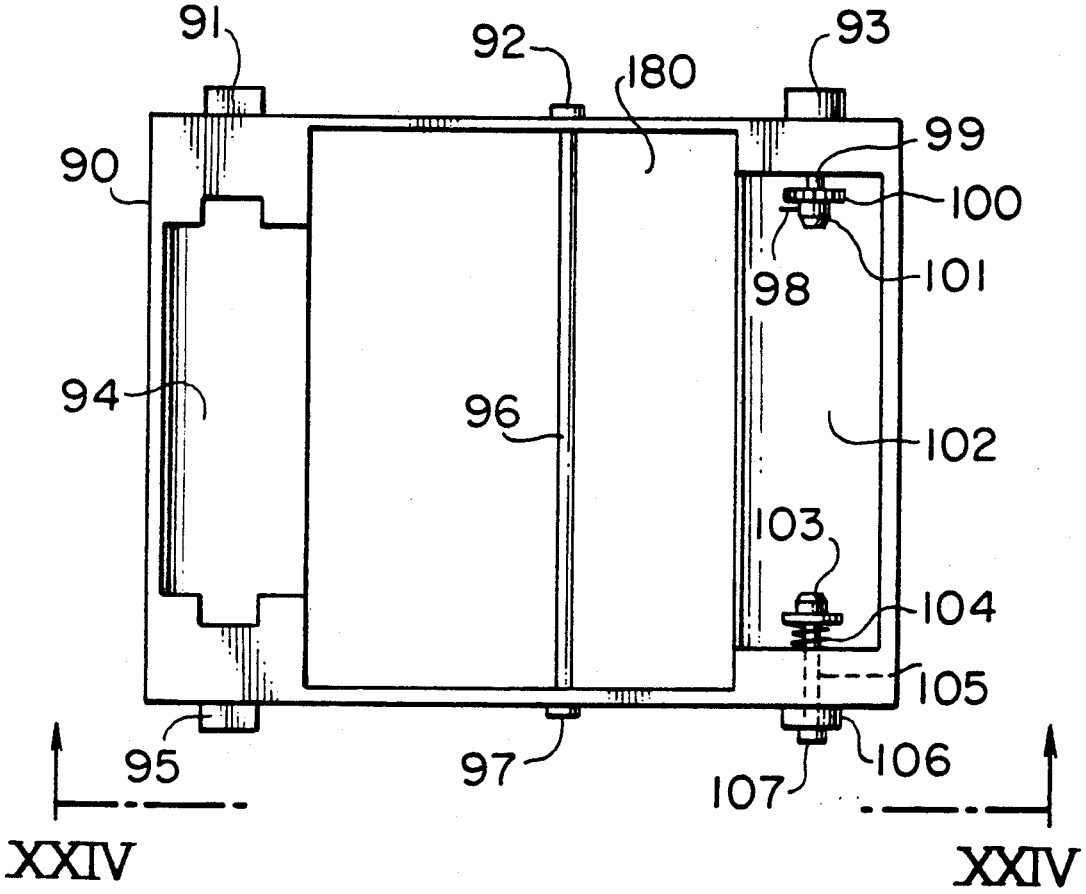
FIG. 23 is a plan view showing a third example of ink cassette of the invention.
Figure 24:
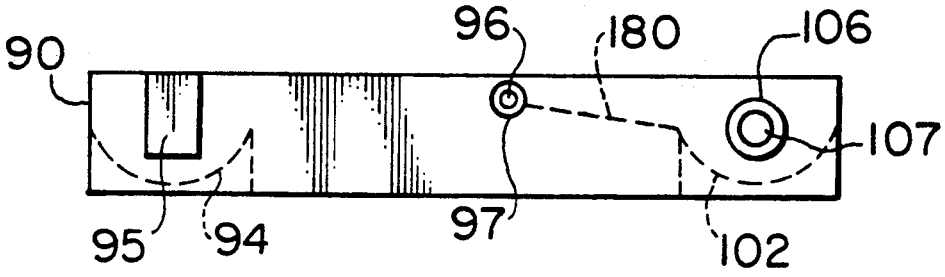
FIG. 24 is a side-elevational view as seen from the line XXIV—XXIV of FIG. 23.

FIGS. 23 and 24 show a third example of ink cassette of the present invention. The ink cassette of this embodiment differs from the ink cassette of FIG. 3 in that a partition plate 180 serving as a passage prevention member is added. In the ink cassette of this construction, when the ink film is to be exchanged, the ink film is passed over the peel guide without fail, thereby preventing an erroneous insertion of the ink film. In the illustrated embodiment, although the partition plate 180 is used, it may be replaced by a net, a grill or the like so long as it can prevent the passage of the ink film or the supply roll therethrough.

Figure 25:
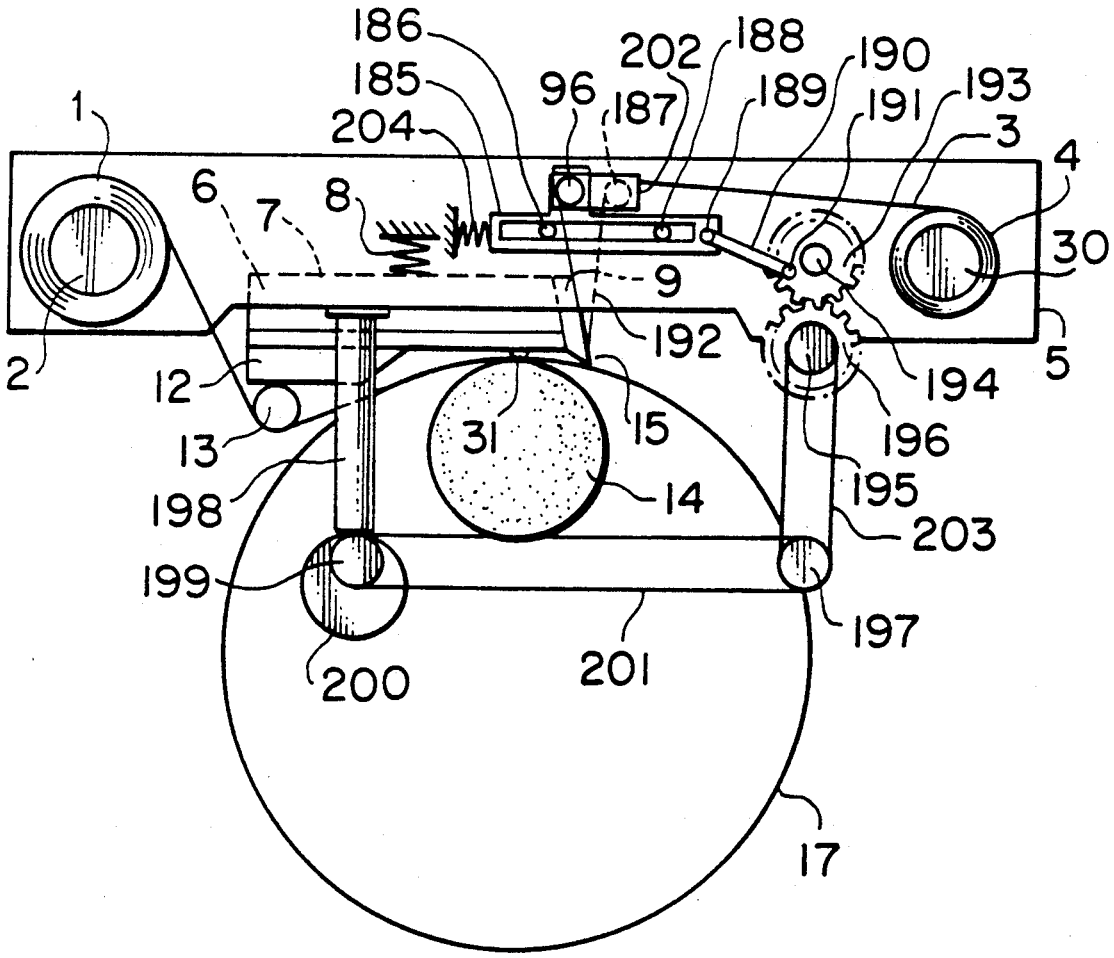
FIG. 25 is a cross-sectional view of an important portion of a fourth embodiment of thermal transfer printing apparatus of the invention.

FIG. 25 shows a fourth embodiment of thermal transfer printing apparatus of the present invention.

A feature of an ink cassette used in the thermal transfer printing apparatus of this embodiment resides in that a peel guide 96 is movable back and forth in the direction of travel of the ink film. Except for this point, the ink cassette of this embodiment is identical in construction to the ink cassette shown in FIG. 23, and therefore explanation thereof is omitted. The ink cassette of this embodiment comprises support pins 186 and 188 mounted on a frame 90 and disposed in the vicinity of the peel guide 96, an arm 185 supported by the support pins 186 and 188 for movement in right and left directions (FIG. 25) along the frame 90, a shaft 194 fixedly mounted on the frame 90 and disposed near one end of the arm 185, a gear 193 rotatably mounted on the shaft 194, a link 190 pivotally connected at one end to the arm 185 by a pin 189 and pivotally connected at the other end to the gear 193 by a pin 191, a spring 204 connected at one end to the arm 185 and connected at the other end to the frame 90 to urge the arm 185 toward the link 190, the peel guide 96 fixedly mounted on the arm 185, and a hole 202 in which the peel guide 96 is inserted so as to move in the direction of travel of the ink film. With this construction, when the gear 193 rotates, the arm 185 supported by the pins 186 and 188 is moved in the right and left directions (FIG. 25) by movement of the link 190, so that the peel guide 96 is also moved in the hole 202 in the right and left directions. On the other hand, the thermal transfer printing apparatus to which the ink cassette of this construction is attached comprises a power-driven pulley 199, an eccentric roller 200 fixedly mounted on a rotation shaft of the pulley 199 for rotation with the pulley 199, a pulley 197 driven for rotation by the pulley 199 through a belt 201, a pulley 195 driven for rotation by the pulley 197 through a belt 203, a gear 196 fixedly mounted on a rotation shaft of the pulley 195 for rotation with the pulley 195, and an up-and-down bar 198 held at one end in contact with the peripheral surface of the eccentric roller 200 and held at the other end in contact with a thermal head 7.

When the ink cassette is attached to the thermal transfer printing apparatus of the above construction, the gear 193 is meshed with the gear 196, and the rotation of the pulley 199 is transmitted to the gear 193, so that the peel guide 96 is moved in the right and left directions in response to the rotation of the gear 193. Also, in response to the rotation of the pulley 199, the eccentric roller 200 is rotated to move the up-and-down bar 198 downward and upward, so that the thermal head 7 is brought into and out of contact with a rubber roller 14.

Therefore, in synchronism with the upward and downward movement of the thermal head 7, the peel guide 96 is moved to a position 187 when the thermal head 7 is brought out of contact with the rubber roller 14 so that the peel guide 96 will not interfere with the thermal head 7, and also the peel guide 96 is moved to a position 96 disposed away from the position of a peel pawl 15 toward the thermal head 7 when the thermal head 7 is brought into contact with the rubber roller 14.

With the above construction of the ink cassette, the peel angle 15 can be made larger, and the effect of reducing the peel force as well as the effect of reducing uneven density is obtained.

Since it is necessary to pull the ink film along a straight path between the peel pawl and the peel guide, the side surface of the peel pawl which faces the ink film after the peeling of the ink film is formed in an inclined manner so that the ink film will not be contacted with the side surface of the peel pawl.

When the ink cassette is detached from the apparatus, the peel guide 96 is urged by the spring 204 into the position 187. Therefore, when the ink cassette is attached to the apparatus, the thermal head will not be engaged with the peel guide, and therefore a lid of the thermal transfer printing apparatus can be closed.

Figure 26:
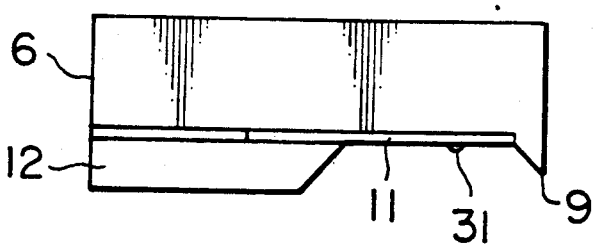
FIG. 26 is a cross-sectional view of a portion of a fifth embodiment of thermal transfer printing apparatus of the invention.

FIG. 26 shows an embodiment of the invention in which a peel pawl 9 is formed integral with a base plate 6 of a thermal head. With this construction, the peel pawl is disposed closer to a heater element 31, and ink in a molten state can be peeled, and therefore the peel force can be reduced, and also an image picture free from uneven density can be obtained. To integrate the peel pawl with the base plate also reduces the time and labor required for the assembling.

Figure 27:
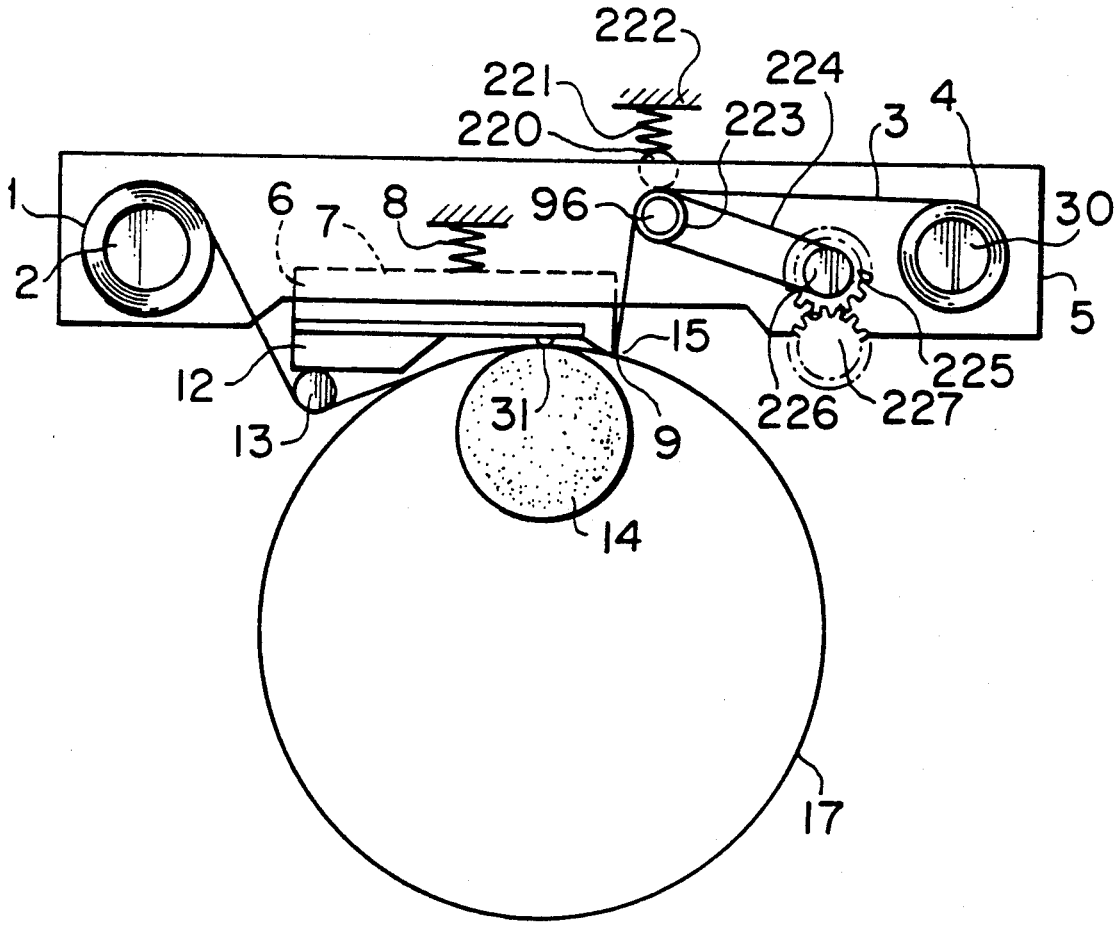
FIG. 27 is a side-elevational view of an important portion of a sixth embodiment of thermal transfer printing apparatus of the invention.

FIG. 27 shows a sixth embodiment of thermal transfer printing apparatus of the present invention. In this embodiment, a peel guide 96 is in the form of a rotatable roller made of a material having a high friction coefficient, such for example as rubber. A pulley 223 is mounted on the end of the peel guide 96, and power is transmitted from a pulley 226 to the pulley 223 through a belt 224. The pulley 226 is integral with a gear 225, and is mounted on a side surface of a ink cassette 5. The gear 225 is in mesh with a gear 227 mounted on the printing apparatus, and receives the power through the gear 227. A roller 220 is mounted on a lid of a printer through a spring 221, and when the lid is closed, the roller 220 cooperates with the peel guide 96 to hold an ink film 3 therebetween.

In the above mechanism, the peel guide 96 is rotated so as to peel the ink film by a peel pawl 9, so that the ink film, while being fed, is peeled. The thus fed ink film is taken up by an ink take-up roll 4. Therefore, the ink film is subjected to tension between the peel pawl and the peel guide, thereby preventing wrinkles from developing in the ink film. The peel roller is driven always under a constant torque regardless of the diameter of the ink take-up roll, and therefore the tension is kept to a constant level, thereby preventing the development of wrinkles, so that a picture image free from uneven density can be obtained. In the above embodiments, although the present invention is applied to the thermal transfer printing apparatus, the invention can be applied to a thermal transfer color printer and an resistive ribbon thermal transfer printer.

In the present invention, thanks to the provision of the peel pawl and the ink guide (which serves as the peel guide), the peel angle can be made larger. This advantageously reduces the peel force and eliminates uneven density.

In the present invention, the tension is applied to the ink film, thereby preventing wrinkles from developing in the ink film.

Also, in the present invention, the structure of the ink layer of the ink film is improved to reduce the peel force.

Further, in the present invention, the ink cassette has the engaging portions of predetermined shape which are engageable in the guide grooves in the apparatus body. Therefore, the ink paper can be easily set in position.

What is claimed is:

1. A thermal transfer printing apparatus including an ink cassette having an ink supply roll and an ink take-up roll, and a thermal head having a heating position for pressing ink paper having a width, fed from said ink supply roll at a supplied angle, against printing paper so as to transfer ink in said ink paper to said printing paper through heating, said ink paper subjected to said transfer being peeled from said printing paper at an angle, and then being taken up in a direction of travel by said ink take-up roll; said apparatus further comprising:

a peel pawl mounted on a first portion of a base plate of said thermal head disposed downstream of the heating position of said thermal head in the direction of travel of said ink paper, said first portion of said peel pawl for being contacted with said ink paper having a V-shape, and extending in a direction of the width of said ink paper; and an ink guide disposed upstream of said ink take-up roll of said ink cassette and downstream of said peel pawl so as to change the direction of travel of said ink paper;

further comprising said ink guide being disposed between said peel pawl and a holder of said ink take-up roll so as to limit the angle between said ink paper, peeled from said printing paper, and said printing paper; and another ink guide disposed between a holder of said ink supply roll and said thermal head so as to limit the supplied angle of said ink paper to be supplied to said thermal head.

2. A thermal transfer printing apparatus including an ink cassette having an ink supply roll and an ink take-up roll, and a thermal head for pressing ink paper, fed from said ink supply roll, against printing paper so as to transfer ink in said ink paper to said printing paper through heating, said ink paper subjected to said transfer being peeled from said printing paper, and then being taken up by said ink take-up roll; said apparatus comprising:

a generally V-shaped peel pawl provided on said thermal head; an ink guide provided on said ink cassette;

said ink paper subjected to said transfer being peeled from said printing paper by said peel pawl and said ink guide; and said ink paper thus peeled being taken up by said ink take-up roll via said ink guide;

wherein said ink guide serves as a rotatable peel guide, said ink cassette including means for rotating said peel guide about a peel guide axis of rotation, a rotatable roller having a roller axis of rotation being mounted on a body of said apparatus so as to cooperate with said peel guide to hold said peeled ink paper between said roller and said peel guide, and the roller axis of rotation of said roller being disposed parallel to the peel guide axis of rotation of said peel guide.

3. A thermal transfer printing apparatus comprising an ink cassette which includes a supply roller holder feeding ink paper, having a width, in a direction of travel, a take-up roller holder, and at least one ink guide provided between said supply roller holder and said take-up roller holder and extending along the width of the ink paper so as to change the direction of travel of said ink paper, wherein said ink cassette further includes a passage prevention member provided between said ink guide, disposed upstream of said take-up roll holder, and said take-up roller holder so as to prevent said ink paper and/or an ink take-up roll from passing through a plane extending between said ink guide and said take-up roll holder.

4. Apparatus according to claim 3, wherein one end of said passage prevention member remote from said take-up roller holder serves as said ink guide, said ink guide serving as a peel guide.

5. A thermal transfer printing apparatus comprising an ink cassette which includes a supply roller holder feeding ink paper, having a width, in a direction of travel, a take-up roller holder, and at least one ink guide provided between said supply roller holder and said take-up roller holder and extending along the width of the ink paper so as to change the direction of travel of said ink paper, wherein said ink guide is movable in the direction of travel of said ink paper, said ink cassette further including means for moving said ink guide toward and away from a thermal head mounted at a position on a body of said thermal transfer printing apparatus, and said moving means is operatively connected to means for changing the position of said thermal head.

6. A thermal transfer printing apparatus including an ink cassette having an ink supply roll and an ink take-up roll, and a thermal head having a heating position for pressing ink paper having a width, fed from said ink supply roll, against printing paper so as to transfer ink in said ink paper to said printing paper through heating, said ink paper subjected to said transfer being peeled from said printing paper at an angle, and then being taken up in a direction of travel by said ink take-up roll; said apparatus further comprising:

a peel pawl mounted on a first portion of a base plate of said thermal head disposed downstream of the heating position of said thermal head in the direction of travel of said ink paper, said first portion of said peel pawl for being contacted with said ink paper having a V-shape, and extending in a direction of the width of said ink paper; and an ink guide disposed upstream of said ink take-up roll of said ink cassette and downstream of said peel pawl so as to change the direction of travel of said ink paper;

wherein said ink guide serves as a rotatable peel guide, said ink cassette including means for rotating said peel guide about a peel guide axis of rotation, a rotatable roller having a roller axis of rotation being mounted on a body of said apparatus so as to cooperate with said peel guide to hold said peeled ink paper between said roller and said peel guide, and the roller axis of rotation of said roller being disposed parallel to the peel guide axis of rotation of said peel guide.

* * * * *